United States Patent [19]

Marvia

[11] 4,365,737

[45] Dec. 28, 1982

[54] CONTAINER FOR LOOSE MATERIAL

[75] Inventor: Kaarlo Marvia, Vantaa, Finland

[73] Assignee: Suomen Sokeri Osakeyhtio, Finland

[21] Appl. No.: 860,047

[22] Filed: Dec. 13, 1977

Related U.S. Application Data

[63] Continuation of Ser. No. 711,162, Aug. 3, 1976, abandoned.

[30] Foreign Application Priority Data

Aug. 5, 1975 [FI] Finland ..... 752220

[51] Int. Cl.[3] ..... B65D 5/12

[52] U.S. Cl. ..... 229/17 R; 229/7 R; 222/528

[58] Field of Search ..... 220/400, 403, 404; 229/7 R, 7 SC, 11, 17 R, 17 B, 17 G, 7; 222/183, 527, 528, 530, 541, 561

[56] References Cited

U.S. PATENT DOCUMENTS

| | | | |
|---|---|---|---|
| 2,337,730 | 12/1943 | Berch | 222/528 X |
| 2,789,747 | 4/1957 | Graybill | 229/17 R |
| 2,899,109 | 8/1959 | Shorkey | 222/528 X |
| 3,179,314 | 4/1965 | Hodgson et al. | 229/17 R X |
| 3,190,531 | 6/1965 | Holmstrom | 229/7 R |
| 3,240,416 | 3/1966 | Deegan | 220/403 X |

OTHER PUBLICATIONS

Cargo Systems, 3/75, pp. 44–49.

Cargo Systems, 12/78, pp. 149–151, 153–155, 146–148.

*Primary Examiner*—Steven M. Pollard

*Attorney, Agent, or Firm*—Goodman & Teitelbaum

[57] ABSTRACT

A container for bulk goods including a rigid box and of a hose of a flexible material placed inside the box in a vertical direction, which hose has a cross section approximately equal to that of an interior space of the box. The hose has a section and a dumping section. The bulk goods is supplied into the hose when the dumping section is closed so as to enclose the bulk goods in the container section. The dumping section, in its closed position, is bent upwards against one side wall of the box. The side wall is opened itself or a gate in the side wall is opened for the purpose of pulling the dumping section out when the container is to be emptied.

3 Claims, 5 Drawing Figures

CONTAINER FOR LOOSE MATERIAL

Figure 1:
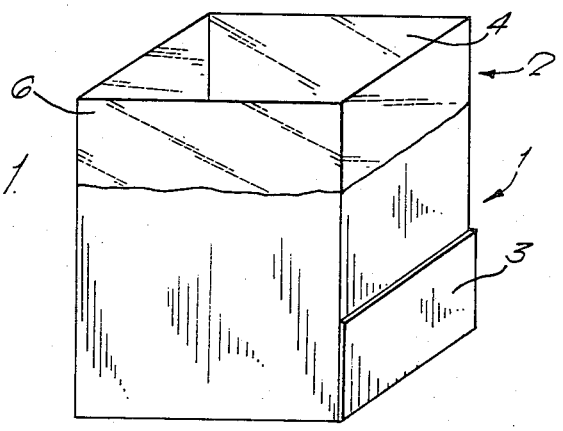

This is a continuation of application Ser. No. 711,162 filed Aug. 3, 1976, now abandoned.

The subject of the present invention is a container for bulk goods, which container consists of a rigid box and of a hose of a flexible material placed inside the box in the vertical direction, which hose has a container diameter approximately equal to that of the interior space of the box and which hose consists of a container section and of a dumping section, whereby the bulk goods is supposed to be supplied into the hose through the top of the container and to be removed from the hose through the lower part of the container and whereby the dumping section of the hose is closed by bending so as to enclose the bulk goods in the container.

Similar containers that are used for the transportation and storage of powder, crystalline as well as particulate goods are previously known. During filling, the upper end of the hose is fastened to the sides of the box open at the top, and the narrow dumping section placed at the centre line of the hose is closed by a suitable closing means. When the container is emptied, the dumping section extending through the bottom of the box is opened. In order that the container should be emptied certainly, the inner bottom of the box is slanting towards the central opening.

Another container in use includes a bag, instead of a hose, in the bottom of which bag a hole is made in connection with the emptying.

These known containers involve certain drawbacks. So, in the first-mentioned container, it is necessary to use a shaped hose and, due to the slanting bottom construction of the box, the box is hard to fold up, and space is lost in between the horizontal bottom and the slanting bottom.

The container in which the bottom is punched when emptying also becomes relatively expensive, because the bag is disposable. Due to the mode of performance of the opening operation, the container is also unhygienic, and it is difficult to control the flow speed of the bulk goods.

It is a purpose of the present invention to avoid these drawbacks and to provide a container that is cheap to manufacture and whose use is both inexpensive and simple. This objective is achieved by means of the container in accordance with the invention. Due to this arrangement, it is possible to use a straight hose as the hose, in which the container section and the pouring section consequently have the same diameter and which is less expensive than a shaped hose or a bag. No extra closing means is required for closing the dumping section and, nevertheless, the same hose can be used several times. As the emptying takes place towards the side, the inner bottom of the box does not have to be made slanting. This results from the fact that, towards the end of the emptying, the box can be slanted, whereby the container is emptied completely. Due to the simple bottom construction, it is also easy to make the box collapsible.

According to the invention, it is favourable that the length of the hose is approximately three times the height of the box. Then there will be a sufficient length for the dumping section. It is preferable to place the dumping section of the hose between the container section of the hose and one side wall of the box, whereby it is protected from outside bumps. As the dumping section is pressed between the container section and the side wall of the container, it also remains closed very well.

The dumping section of the hose can advantageously be turned on a roll.

Figure 2:
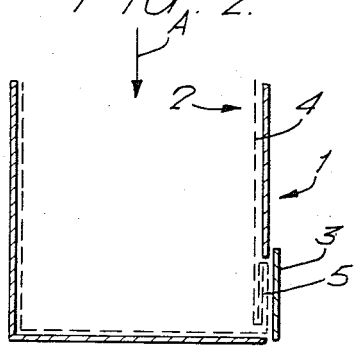
Figure 3:
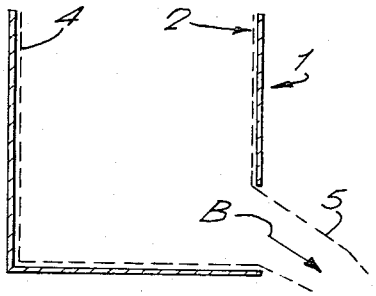
Figure 4:
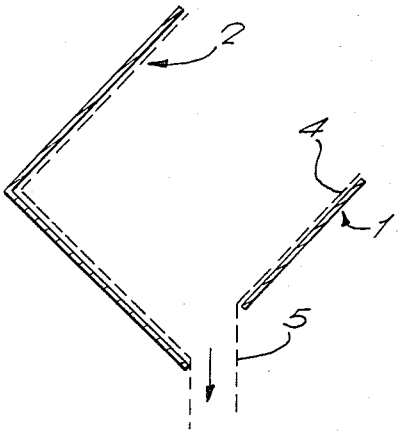
Figure 5:
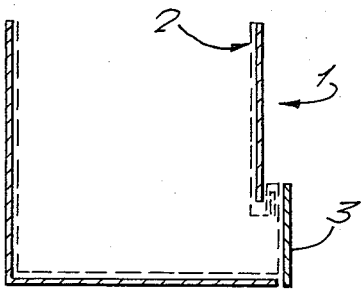

The container in accordance with the invention will be explained below more closely with reference to the attached drawing, wherein FIG. 1 shows an axonometric view of an embodiment of the container in accordance with the invention, FIG. 2 schematically illustrates the filling of the container, FIG. 3 schematically shows the emptying of the container, FIG. 4 schematically shows the final emptying of the container, and FIG. 5 schematically shows a side view of another embodiment for FIG. 2.

The container in accordance with the invention mainly consists of a rigid box 1 and of a hose 2 placed inside the box, which hose is of some flexible material, such as plastics or fabric. The hose is illustrated in the FIGS. 2 to 5 by broken lines. The box is collapsible, whereby it takes little space in the transportation and storage thereof. At the lower portion of one of the side walls, there is a gate 3 which can be detached altogether.

The hose, of a constant diameter, consists of two parts, a container section 4 and a dumping section 5. Moreover, in FIG. 1, the upper end 6 of the hose is folded over the upper edge of the box so as to fasten the upper end of the hose to the box. The diameter of the hose is approximately equal to the inner diameter of the box, so that the hose fills the inside space of the box completely.

As the bottom of the hose is open, the hose 2 is longer than the height of the box plus its length perpendicular to the gate, as added together, so that, when the hose is unfolded in the box, a portion thereof is still left over that forms the dumping section 5, which is closed by bending bent upwards along the side wall of the box, as is shown in FIGS. 2 and 5. In practice it has been found that a hose whose length is approximately three times the length of the box is suitable in connection with a box of the illustrated shape.

The dumping section is turned 180° in relation to the container section several times, as in FIGS. 2 and 5. This closing arrangement is appropriate when there is a gate 3 in the lower portion of the side wall and so the dumping section 5 is in this case rolled against the inside of the gate.

A container in accordance with the invention is used as follows:

After the box 1 has been assembled, the hose 2 is placed in the box in the way shown in FIGS. 1, 2 or 5, at which time the dumping section is bent upwards along the side wall of the box and the upper end of the hose is, in some way or other, fastened to the upper edge of the box. Hereupon the box is filled with bulk goods in the direction indicated by the arrow A. After filling, a cover is placed onto the box, or the upper end of the hose is detached from the box and closed, for example, by means of a cord.

When the container is being emptied, the gate 3 is taken away, and the dumping section 5 of the hose is taken out. The contents of the container then start flowing out in the direction of the arrow B. The flowing speed can be controlled easily by adjusting the flow opening and the position of the dumping section 5.

When the outflow stops, the container is inclined in the way shown in FIG. 4, whereby the container section 4 of the hose is emptied completely.

FIG. 5 shows the positioning of the dumping section mentioned above between the lower portion of the wall provided with a gate and the upper portion of the inner wall of the gate.

What I claim is:

1. A container for bulk goods in powder, crystalline and particulate form comprising:

(a) a rigid collapsible box having side walls, a top portion and a bottom;

(b) a hose fabricated from a flexible material, said hose having a uniform cross section approximately equal to an interior cross section of said box at said side walls, said hose having a length longer than said side walls of said box, said hose being open at opposite ends to provide an open top section and an open dumping section with a container section disposed between said top and dumping sections;

(c) said hose being disposed inside said box with said top section being positioned adjacent to said top portion of said box, said container section being juxtapositioned to at least three of said side walls of said box and against said bottom of said box, and said dumping section being folded upwardly from said bottom of said box and being juxtapositioned between said container section and a fourth side wall of said box in a sandwiched arrangement therebetween;

(d) said top section of said hose including means for permitting the bulk goods to be supplied into said container section of said hose through said top portion of said box, said means including a portion of said hose top section for folding over an upper edge of said top portion of said box when said box top portion is in an open position;

(e) said fourth side wall being provided with opening means adjacent to said box bottom for allowing said dumping section of said hose to be pulled out therethrough when said container section is to be emptied, where said dumping section is pulled out to an outwardly extending position at a lower part of said fourth side wall adjacent to said box bottom; and (f) said opening means including a detachable gate member disposed at said lower part of said fourth side wall, said detachable gate member having a length equal to width of said fourth side wall.

2. A container as claimed in claim 1, wherein said dumping section of said hose is disposed against said detachable gate member in said sandwiched arrangement with said dumping section being folded back against itself.

3. A container as claimed in claim 1, wherein an end portion of said dumping section of said hose is sandwiched between an outer lower surface of said fourth side wall and an inner upper surface of said detachable gate member with said inner upper surface of said detachable gate member extending across said outer lower surface of said fourth side wall.

* * * * *